US007244340B2

(12) United States Patent
Laithier et al.

(10) Patent No.: US 7,244,340 B2
(45) Date of Patent: Jul. 17, 2007

(54) CREPING BLADE

(75) Inventors: Jean Francois Laithier, Penthalaz (CH); Silvano Freti, St. Prex (CH)

(73) Assignee: BTG Eclepens S.A., Eclepens (CH)

( * ) Notice: Subject to any disclaimer, the term of this patent is extended or adjusted under 35 U.S.C. 154(b) by 396 days.

(21) Appl. No.: 10/807,397

(22) Filed: Mar. 24, 2004

(65) Prior Publication Data

US 2005/0051292 A1 Mar. 10, 2005

(30) Foreign Application Priority Data

Sep. 8, 2003 (SE) ..... 0302400

(51) Int. Cl.
*B31F 1/12* (2006.01)

(52) U.S. Cl. ..... 162/281; 162/280; 15/256.5

(58) Field of Classification Search ..... 162/281, 162/280; 15/256.5
See application file for complete search history.

(56) References Cited

U.S. PATENT DOCUMENTS 3,688,336 A 9/1972 Costello, Jr. et al.
5,727,468 A 3/1998 Blackwell
6,074,526 A 6/2000 Marinack
6,207,021 B1 3/2001 Eriksson et al.

FOREIGN PATENT DOCUMENTS

GB 2 128 551 5/1984
WO WO 97/22729 6/1997
WO WO 99/64674 12/1999

*Primary Examiner*—Mark Halpern
(74) *Attorney, Agent, or Firm*—Buchanan Ingersoll & Rooney PC

(57) ABSTRACT

A blade for creping has been described. The blade according to the invention has a ceramic top layer covering the working edge of the blade, as well as the surface upon which the web impacts during creping. The ceramic top layer is a ceramic composition having a content of chromia. Preferably, the ceramic composition of the top layer comprises chromia-titania, with a titania content of up to 25% by weight, and preferably between 10% and 15% titania.

15 Claims, 11 Drawing Sheets

CREPING BLADE

This application claims priority over application 0302400-7 filed in Sweden on 8 Sep. 2003.

TECHNICAL FIELD OF THE INVENTION

The present invention relates to blades for creping. More particularly, the present invention relates to creping blades provided with a ceramic coating.

TECHNICAL BACKGROUND

Creping doctor blades are commonly used in the production of tissue. The blades have the function of detaching a paper web from a rigid, hot dryer cylinder (often called a Yankee dryer) and at the same time exert a compressive action on the web thereby creating the typical crepe structure of a tissue product.

Nowadays, the creping blade must fulfill many requirements:

- The blade must overcome the adhesive forces which stick the paper web on the dryer surface, the adhesion being promoted (for purposes of drying the web) by a chemical coating applied to the dryer by means of a spray-boom.
- The blade should create the desired crepe structure in the web and thereby provide the right bulk, softness and mechanical strength to the tissue. For this aspect, the geometry of the blade tip is important. A square edge blade (90 degrees) in a given creping situation will create a different tissue than a blade with a sharp edge of say 75 degrees in the same creping situation. The former situation gives a higher bulk and coarser crepe structure than do the latter.
- The blade should keep the tissue parameters as constant as possible for the longest possible period of time. In other words, the wear of the blade tip and its interaction with the layer of coating chemicals on the web are important factors.
- The blade should be as friendly as possible against the dryer surface. This means that any wear should predominantly or exclusively occur on the blade, rather than on the dryer surface. The surface of the dryer can be either cast iron (same material as the bulk of the cylinder, i.e. a cylinder without any surface deposit) or a metallization obtained by, for example, thermal spraying. As an example, WO 97/22729 describes a method for coating Yankee dryers.

Creping blades are subjected to wear for different reasons. First there is sliding wear against the dryer, and second there is impact wear due to the web hitting the blade during creping. It has been found that the progressive wear of the creping blade is directly related to unwanted evolution of the tissue properties, such as changes in bulk and softness. Practical experience, after having reviewed many tissue mills, has shown that the best properties of the tissue are obtained only with a new blade. For steel blades, this period of good properties could be as short as one reel only.

In order to accommodate for such behavior (i.e. blade wear), tissue makers are specifying ranges of properties which are said to be acceptable. Nevertheless, there would be a high industrial demand for the tissue quality reached in the very first part of the first reel after a blade change. When the targeted range of tissue properties is not reachable anymore, the creping blade is changed for a new one, obtaining again the desirable characteristics but which are rapidly decreasing. Generally, steel blades of grade type such as AISI 1074 in quenched and tempered states are used. Such blades generally show rapid wear and consequently rapid changes in tissue quality, as well as possible micro-welding issues with the dryer surface and a so-called hot waving behavior.

For the reasons mentioned above, there has been made several attempts to improve the behavior of such blades by adding hard, wear resistant materials at the blade tip.

U.S. Pat. No. 3,688,336 explain the possibility to add a wear resistant material at the blade tip by a suitable method of the thermal spraying type. The desire to avoid chipping of the wear resistant material was recognized. The referenced U.S. patent proposes the solution to use a groove at the blade tip and a break-in space between the wear resistant material in the groove and the leading edge of the blade.

GB 2,128,551 discloses a multipurpose scraper which may be used as a creping blade, having an edge coated by thermal spraying in many passes with a wear resistant material from the ceramic or metal carbide families. More specifically, alumina-titania is presented. Focus is further made on flexibility and again is the need for minimum brittleness emphasized.

Other documents, such as U.S. Pat. No. 6,207,021 and U.S. Pat. No. 6,074,526, teach the possibility to create a recess on the blade tip in order to obtain an essentially constant contact surface against the dryer, and by this feature a constant scraping efficiency. Apart from the fact that such solutions are very much increasing the manufacturing costs for the blade, by virtue of elaborate and accurate grinding, such solutions are in practice exposed to blade tip failure due to hot friction wear and possible plastic flow of the reduced portion of the blade remaining at disposal for sliding wear.

Today, thermally sprayed ceramic tipped blades are used in the tissue industry. Ceramic compositions including alumina, alumina-titania and alumina-zirconia are well known in the field. The 60%/40% alumina-zirconia fulfills the basic requirements of good sliding wear against cast iron, very high fracture toughness and at the same time a relatively low hardness. Although creping blades having these features may bring benefits in terms of lifetime, they still suffer from a number of drawbacks:

1. Firstly, there is a large variation in blade lifetime due to chipping problems of the ceramic edge.

The blade has to be removed and replaced after a lifetime which can be anywhere between 5 minutes to 12 hours. It has been observed in practice that most of the failures observed when using ceramic tipped blades occur during the very first period after a blade change. If relatively small, such chips are responsible for what is often called "tram-lines" on the mother reel when winding. With increasing size of such chips in the blade, or decreasing grade of the tissue to lower grammages, the chips may cause web breaks and holes on the tissue. This impairs productivity and quality. In conjunction to this point, the clear trend to use more and more recycled fibers in tissue production leads to more and more high ash content and foreign particles being entrapped in the tissue-making process, thereby promoting even more chipping of the leading edge of the state of the art ceramic tipped creping blades.

2. Secondly, another limitation for such state of the art, thermally sprayed ceramic tipped blades is that for high quality tissue, such as facial towels, the conventional ceramic blade is not able to keep the very demanding tissue characteristics for any prolonged time. The inspection of worn ceramic blades shows that the impact of the tissue is much closer to the leading edge in such case compared to the situation for less quality demanding tissue. This can be understood by considering the fact that the high softness is obtained by having a very high adhesion onto the dryer surface, the web detachment and its impact thereby being close to the leading edge of the creping blade. The consequence is that once again chipping, in this case minute microchips, develop at the tip of the ceramic blade, leading to a "rounded" edge. Consequently, the tissue properties decreases rapidly even when using a ceramic tipped blade. For such situation, the solution in line with U.S. Pat. No. 3,688,336 referenced above will be useless because the impact will occur in the unprotected "breaking-in space".

The use of creping blades tipped with thermally sprayed metal carbides, such as for example WC—Co or WC—Co—Cr is known. Such materials are less brittle than sprayed ceramic and therefore less sensitive to edge chipping. Nevertheless, the use of such materials should be avoided due to other drawbacks, namely:

There is a potentially higher wear rate of the dryer surface, and potentially high damage due to chatter marks if vibrations develop within the tissue machine and are transferred to the creping blade.

Metal carbides are constituted by a metal matrix with embedded carbides. Such situation may promote the micro-welding events between the blade and the dryer surface at the high temperatures present in the sliding contact. This may lead to transfer of material from the dryer to the blade, causing premature wear or damage to the surface of the high cost dryer cylinder or costly metallization.

Another limitation of metal carbides derives from their high thermal conductivity. The friction wear is creating a large amount of heat, adding to the temperature of the already hot dryer surface. Steel creping blades or creping blades made of a steel substrate with an edge coating of metal or metal carbide may obtain a blue color at about 10 mm from the tip, which count for temperature exceeding 300° C. On long blades (wide machines), the steel expands sufficiently to create waving of the blade, instabilities in the blade holder, difficulties to unload blades and possibly damages to the Yankee drum, in particular when unloading such a hot blade. This is the so-called hot waving behavior.

Consequently, there is a need in the tissue industry for a creping blade with improved behavior, including the advantageous features of ceramic materials from a friction standpoint, but lacking the chipping drawbacks resulting from material brittleness.

SUMMARY OF THE INVENTION

One object of the present invention is therefore to provide a creping blade having a thermally sprayed ceramic tip, which blade does not present the limitations due to chipping (macro chips) explained above, thereby avoiding the large fluctuations in blade lifetime.

A second object of the invention is to provide a blade that is more resistant to microchips when used on high quality tissue, such as facial tissue, allowing for the tissue properties to be maintained within the desired range for a longer period of time, i.e. an extension of the blade lifetime.

Another object of the invention is to provide a blade which is compatible with various types of Yankee dryer surfaces, e.g. both cast iron and metallisations, without premature wear of the dryer surface or material transfer from the dryer surface to the sliding contact of the blade due to microwelding.

Yet another object is to provide a very low sliding wear rate of the creping blade in order to maintain the scraping efficiency of the blade as constant as possible.

The surprising observation on which the present invention is founded is that the use of a sprayed ceramic compound which is more brittle than alumina-based products will enable the solution of the chipping problem in creping blade applications, and at the same time fulfill the other objects mentioned above. It has been found, to the surprise of the skilled person, that creping blades tipped with a ceramic of chromia ($Cr_2O_3$), or of chromia-titania ($Cr_2O_3/TiO_2$), applied by thermal spraying typically exhibit no chipping at the leading edge of the blade, neither small edge microchips nor any macro chips.

Typically, the ceramic material covers the blade substrate at least over the section thereof adapted for contact with the dryer cylinder (the working edge), as well as the section thereof upon which the web impacts during creping. Hence, the ceramic composition of the present invention improves both the sliding wear of the blade against the dryer cylinder, and the impact wear in the area of the blade where it is hit by the web.

Blades tipped with thermally sprayed chromia or chromia-titania with a titania-content of up to 25% by weight have been found to be suited for all creping requirements described above, as will be elucidated in the summary and the various examples that follow.

It is preferred that the ceramic coating on the blade tip is chromia-titania ($Cr_2O_3/TiO_2$) with up to 25% by weight titania ($TiO_2$), more preferably 5% to 15% by weight titania ($TiO_2$), and most preferably with 10% to 15% titania.

The addition of titania to the ceramic composition also provides improved toughness, thereby facilitating coiling of the blades during, or subsequent to, manufacture. It has been found that delamination could occur between the ceramic deposit and the blade substrate when coiling the blade if the toughness of the ceramic deposit is too low. However, added toughness has lesser value if the blades are produced in a flat process without coiling.

The chromia or chromia-titania ceramic deposit according to the present invention is a single phase coating without any lamella of titania in the coating microstructure. It is believed that this fact adds to the wear resistance of the coating. In a multiphase material, each phase generally behaves differently to wear, leading to roughening of the creping surface and an increased risk of web breakage. This becomes particularly important for low grammage tissue. The use of a single phase ceramic top layer according to the present invention provides uniform wear, leading to a smooth surface over the entire lifetime of the creping blade. This will be shown in more detail in the description below.

BRIEF DESCRIPTION OF THE DRAWINGS

In the following, a detailed description of the invention will be given by way of preferred embodiments and practical examples. The description is given in conjunction with the accompanying drawings, on which.

DETAILED DESCRIPTION OF EMBODIMENTS

Figure 1:
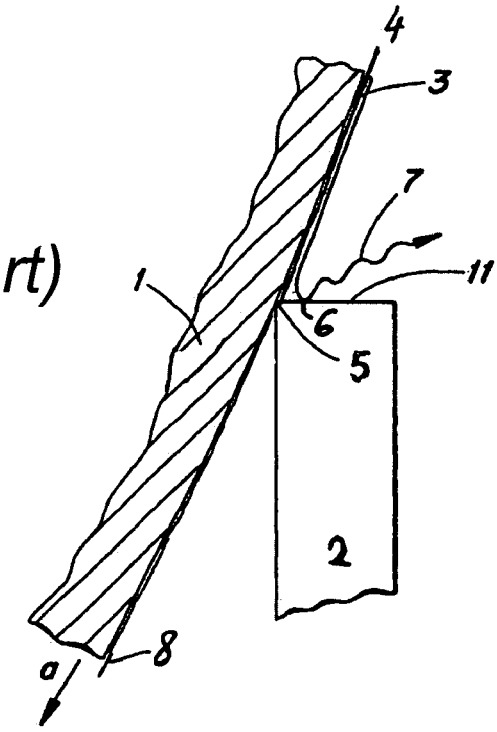
Fig. 1 (Prior Art)
FIG. 1 illustrates the region of engagement between the surface of a dryer cylinder and the working edge of a newly installed creping blade according to the prior art (steel blade)

An embodiment of the creping blade according to the present invention can comprise the following:

- a steel substrate having a thickness in the range from 0.635 to 1.250 mm; and a width in the range from 50 to 150 mm, preferably in the range from 75 to 120 mm;
- a prebevel on the steel substrate, with an angle in the range from 0 (no prebevel) to 10 degrees, preferably from 4 to 8 degrees;
- a bond coat, suitably applied by thermal spraying of Ni—Cr (80/20) for example by atmospheric plasma spraying (APS) to a thickness in the range from 10 to 50 microns;
- a ceramic top layer at the working edge of the blade, the ceramic being a composition of chromia or chromia-titania, suitably applied by for example APS, having a thickness at the front of the blade in the range from 150 to 300 microns, preferably from 200 to 300 microns;
- a final grinding of the blade to the desired front bevel, from about −15 degrees (75 degree blades) to about +15 degrees (105 degree blades) in accordance with the intended application;
- a chamfer bevel at the blade tip, on the surface facing the dryer, with a length in the range from 0 mm (no chamfer) to 0.5 mm, and with a bevel lower than the sliding bevel in the range from 3 to 15 degrees, preferably from 6 to 12 degrees.

Although the technical effect of the present invention is, for most cases, obtained with a ceramic top coating comprising no other ceramic material than chromia (i.e. 0% or close to 0% titania), it is preferred to have a top coating of chromia-titania, where the titania content is in the range from 5% to 25% by weight, preferably from 10% to 15%.

By way of introduction, the performance of the creping blade according to the invention will be briefly outlined with reference to FIGS. 1–4, where a prior art blade is compared to the inventive blade.

FIG. 1 illustrates the use of a prior art creping blade and shows the situation for a newly installed steel blade. The creping blade 2 is shown in engagement with the surface of a dryer cylinder 1. The dryer moves according to the arrow a, transporting paper web 3 and a coating chemical layer 4 up to the working edge 5 of the blade 2. The paper web 3 hits the surface 11 of the blade at a point 6 near the edge 5 thereof, and the web 3 is thereby compressed and changes direction in the form of a creped tissue 7. As illustrated in the figure, the coating chemical layer 4 is partially scraped off by the working edge 5 of the creping blade, but some material of this chemical layer 8 remains on the surface of the dryer 1. If the degree of adhesion between the web and the cylinder surface is very high, then point 6 corresponding to the web impact area upon the creping blade can be very close to the working edge 5 or even superimposed.

Figure 2:
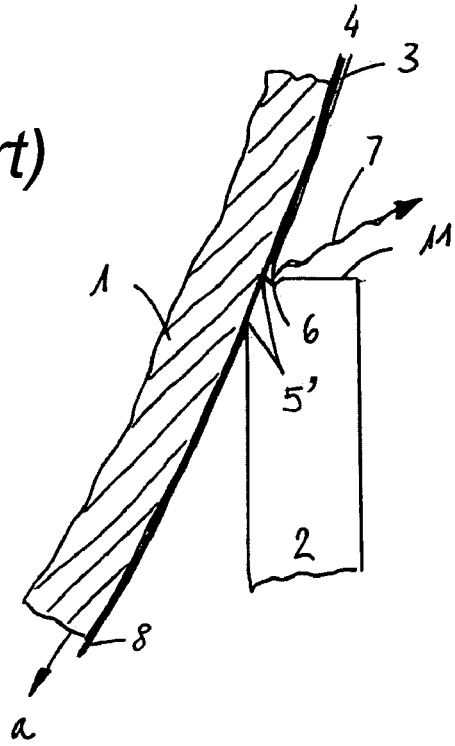
Fig. 2 (Prior Art)
FIG. 2 illustrates the region of engagement between the surface of the dryer and the working edge of a worn creping blade according to the prior art (steel blade) after a certain working time.

FIG. 2 again illustrates the use of the prior art creping blade, but now after a working time of t1. Hence, FIG. 2 shows the situation for a worn prior art creping blade 2 due to sliding against the dryer surface. The working edge 5 as shown in FIG. 1 is now replaced by a sliding surface 5'. The impact wear located in the area 6 has created a groove on the surface 11 of the blade. Due to the usual constant linear load applied to the blade tip, the development of the sliding surface 5' will directly decrease the scraping efficiency of the blade 2, whereby the amount of residual chemical layer 8 will increase over time.

Figure 3:
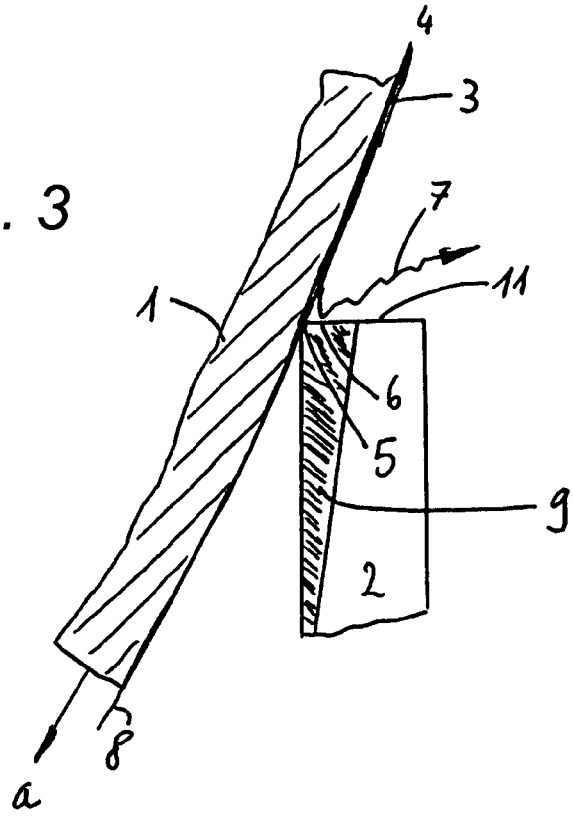
FIG. 3 illustrates the region of engagement between the surface of the dryer and the working edge of a newly installed creping blade according to the present invention.

FIG. 3 illustrates the use of a creping blade 2 according to the present invention and shows the situation for a newly installed blade. The blade is in contact with the dryer surface at the edge 5. The chromia or chromia-titania layer is represented by the darker area 9 in the figure. In this example, the prebevel given to the steel substrate causes the ceramic coating to have a wedge shape as indicated by the darker area 9 in the figure.

Figure 4:
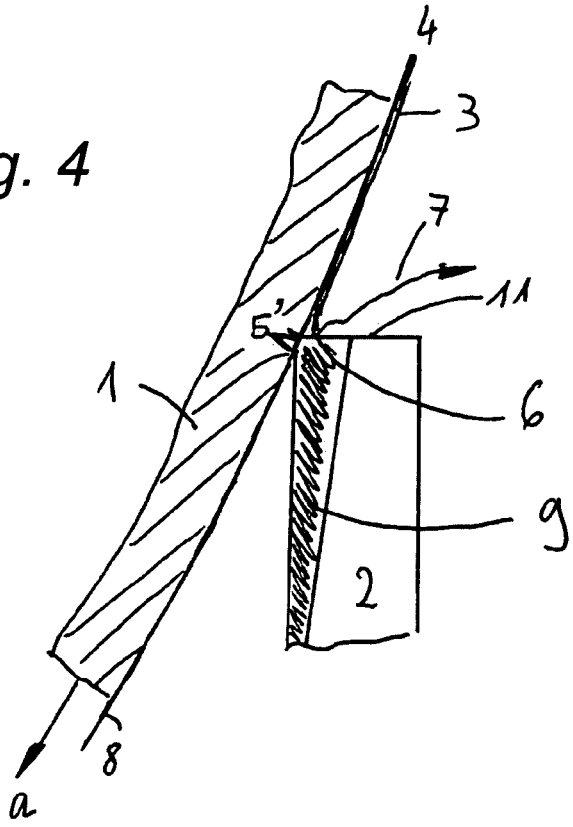
FIG. 4 illustrates the region of engagement between the surface of the dryer and the working edge of a creping blade according to the present invention after a similar working time as that of FIG. 2 for the prior art blade.

FIG. 4 again illustrates the use of a creping blade 2 according to the present invention, but now after a working time of t1 (similar working time as shown in FIG. 2 for the prior art steel blade). Hence, FIG. 4 shows the situation for a worn creping blade according to the present invention. The sliding wear rate is much lower compared to the situation for the prior art blade shown in FIG. 2, and the sliding bevel 5' is so small that it is practically similar to an edge. As a consequence, for a given linear load applied to the blade tip, the scraping efficiency of the inventive blade is only slightly lower compared to a newly installed blade, and the residual amount 8 of the coating chemical layer 4 has only increased by a small amount.

EXAMPLES

In order to determine the performance of the creping blades according to the present invention, a number of comparative trials were performed.

Example 1

In a tissue mill, trials were performed with three different types of creping blades. The first type, labeled A, was a blade according to the present invention, having a ceramic top coating of chromia-titania with 15% titania content. The second type, labeled B, was a prior art ceramic tipped blade with an alumina-based material for the ceramic coating. The third type, labeled C, was a prior art metal carbide blade.

The running conditions for the creping process were the following:

paper web made from 100% recycled fibers;
industrial towel type tissue;
grammages of 19, 22 and 28 g/m$^2$, with wet strength;
Yankee speed of 1050 m/min;
Crepe ratio of 15%;

Yankee surface comprised of Metso Curemate-78, a HVOF WC-Co-Cr coating;

web moisture of 3.5–4%;

creping blade dimensions of 1.2×100×2980 mm (thickness×width×length);

a blade bevel of 85 degrees (−5 degrees from square edge);

a blade load of 2.5 bars (280 kgf/m on the reading scale);

a base adhesive composition comprised of Cyltac (Key Chemicals) 133 @37 ml/min or 2.3 mg/m$^2$;

a release composition comprised of Cylube (Key Chemicals) 112 @16 ml/min or 4.6 mg/m$^2$;

a modifier composition comprised of Cyltac 420 (Key Chemicals) (DiAmmoniumPhosphate)@17 ml/min or 1.8 mg/m$^2$.

Blade A (the blade according to the present invention) was run for 19 hrs and was not at the end of its lifetime. Blade B was run for 11 hrs and was removed due to 2 chips occurring. Blade C was run for 20 hrs and was at the end of its lifetime.

Figure 5:
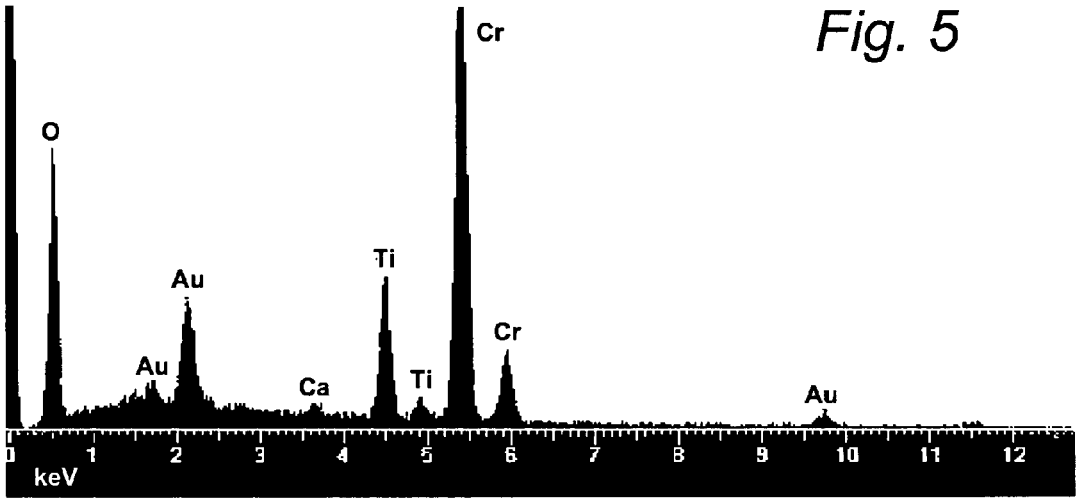
FIGS. 5 to 7 represent EDX spectra for blade sliding bevels and are referred to in Example 1 below.

FIG. 5 represents an EDX (Energy Dispersive X-ray) spectrum made on the sliding bevel of blade A after 19 hrs running time. No peaks are found related to the material of the Curemate-78 surface (W—Co—Cr). The peaks from Cr, Ti and O are related to the ceramic composition of the creping blade coating, and the peak from Au is due to gold sputtering of the sample.

Figure 6:
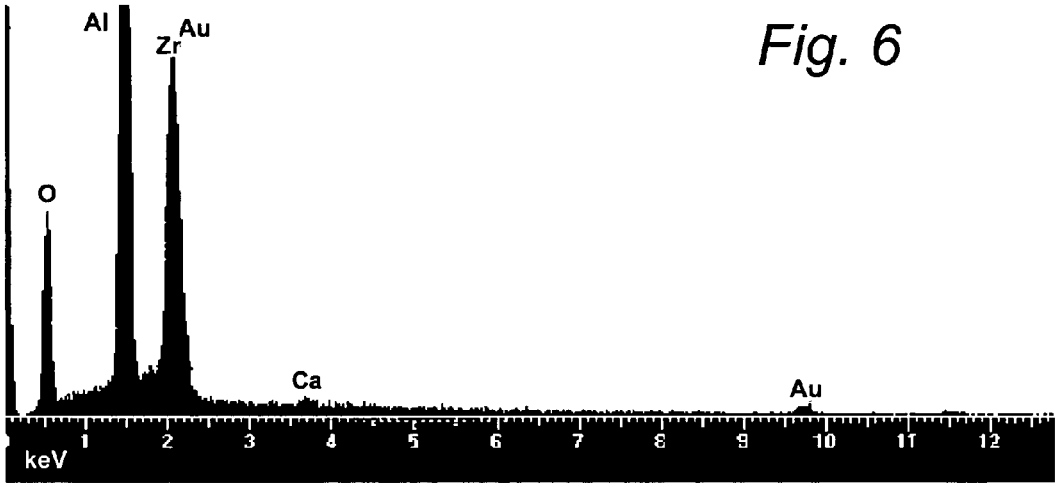

FIG. 6 represents an EDX spectrum made on the sliding bevel of blade B after 11 hrs running time. Again, no peaks are found related to the material of the Curemate-78 surface. The peaks from Al, Zr and O are related to the ceramic composition of the creping blade coating, and the peak from Au is due to gold sputtering of the sample.

Figure 7:
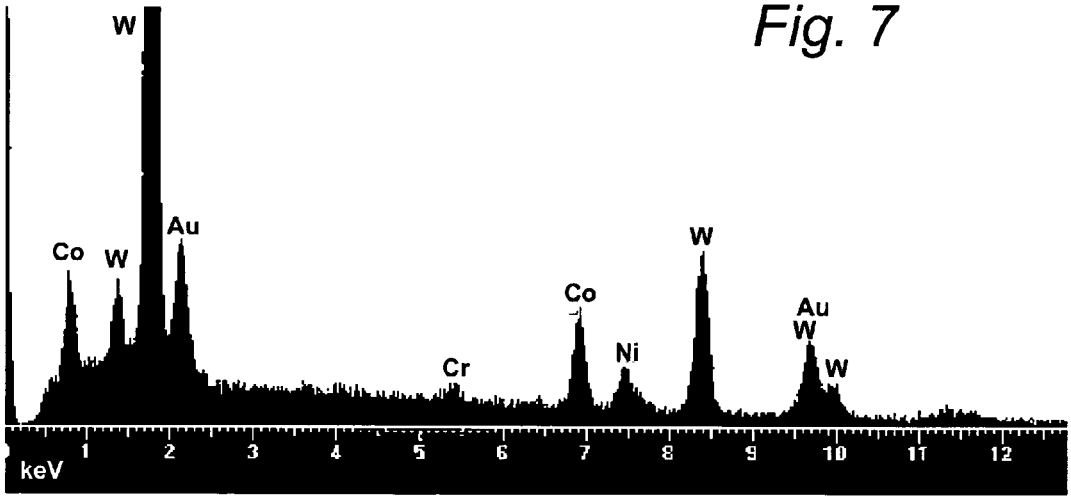

FIG. 7 represents an EDX spectrum made on the sliding bevel of blade C after 20 hrs running time. The blade material is WC—Co without any Cr content. A small but clearly visible Cr peak in this spectrum is related to the material of the Curemate-78 surface of the Yankee (W—Co—Cr). Although not quantitative, this is a sign of friction/microwelding interaction between the material of the blade and that of the Yankee dryer surface.

Figure 8:
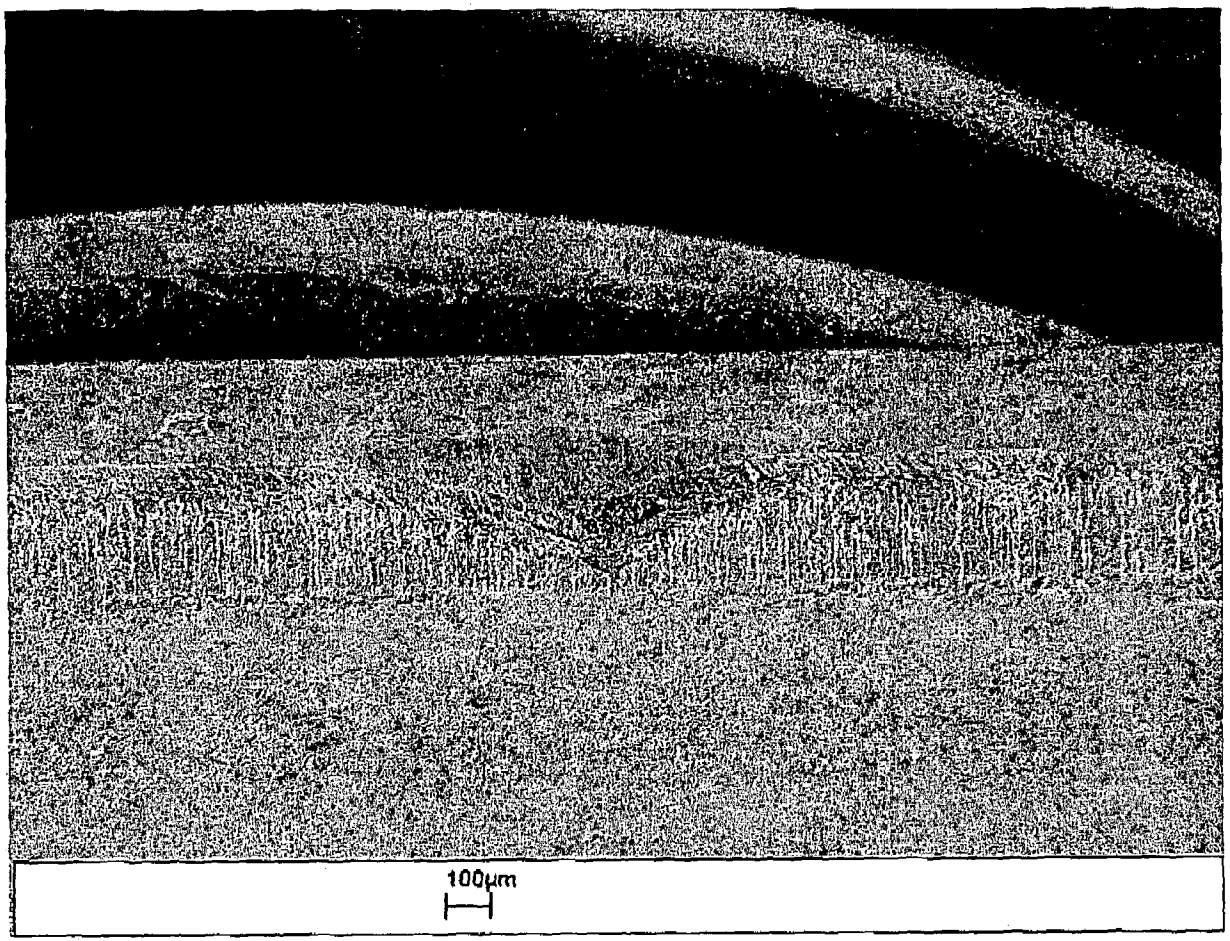
FIG. 8 is a SEM view of a macro chip event and is referred to in Example 1 below.

Moreover, FIG. 8 is a SEM view of a macro chip that occurred on blade B. The failure of the ceramic created a line defect on the tissue web, which is unacceptable and therefore lead to a blade change.

As a conclusion of this example, the state of the art ceramic tipped blade (blade B) is sensitive to macro chips. The state of the art metal carbide tipped blade (blade C) is not particularly sensitive to macro chips but show signs of unwanted interaction with the dryer Curemate-78 surface. The blade according to the present invention (blade A) combines the benefits of the two state of the art blades.

Example 2

On another tissue machine, currently employing alumina-based creping blades, a trial of ten blades according to the invention was performed.

The running conditions for the creping process were the following:

paper web made from 100% deinked fibers (recycled);

toilet paper tissue type;

grammage of 16 g/m$^2$;

Yankee speed of 770 m/min;

Yankee surface comprised of cast iron;

Reel speed of 560 m/min (crepe ratio 27%);

web moisture of 3%;

creping blade dimensions of 1.2×120×3420 mm (thickness×width×length);

a blade bevel of 85 degrees (−5 degrees from square edge);

a blade load of 2.5 kN/m;

a stick-out of 60 mm.

The ceramic blades currently used on this machine exhibits a very large variation in blade lifetime, ranging from 1 hour up to over 100 hours. The lifetime of the currently used alumina-based ceramic tipped blades is limited mainly by chipping problems, and the average lifetime is about 50 hours.

The lifetime of the ten blades according to the present invention tested on this machine were (in hours) 77-116-60-142-76-50-65-109-44-124, with an average of 86 hours and a minimum lifetime of 44 hours. Change of blade was in this case dictated by a change in paper grade, and not by chipping problems.

Figure 9:
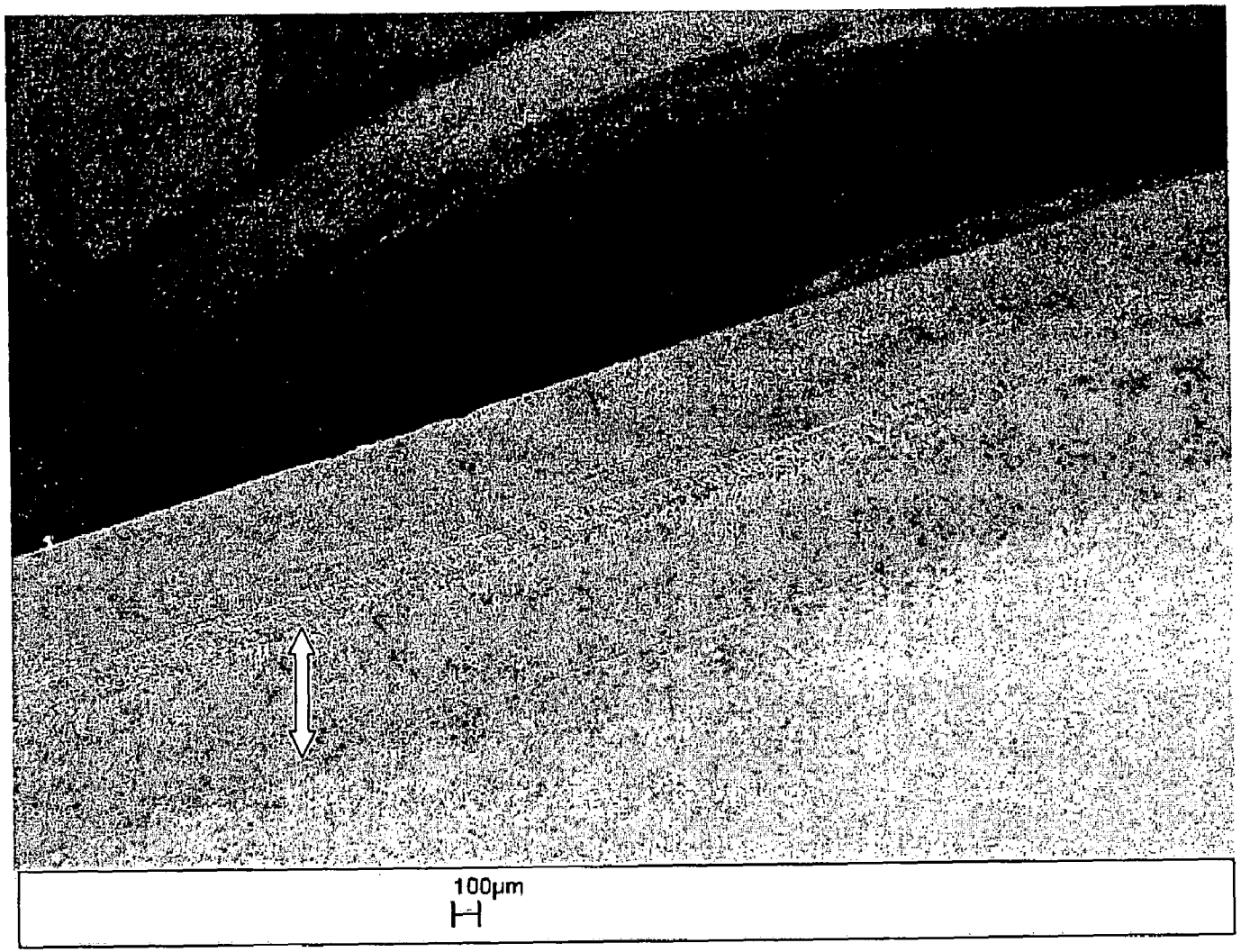
FIGS. 9 and 10 are SEM views of the working edges of creping blades and are referred to in Example 2 below.

An alumina-based ceramic tipped blade was run on the machine for 131 hours and then inspected in a scanning electron microscope (SEM). FIG. 9 represents an SEM view of the edge of that blade. The sliding wear path, indicated by the arrow in the figure, was found to have a width of 550 μm.

Figure 10:
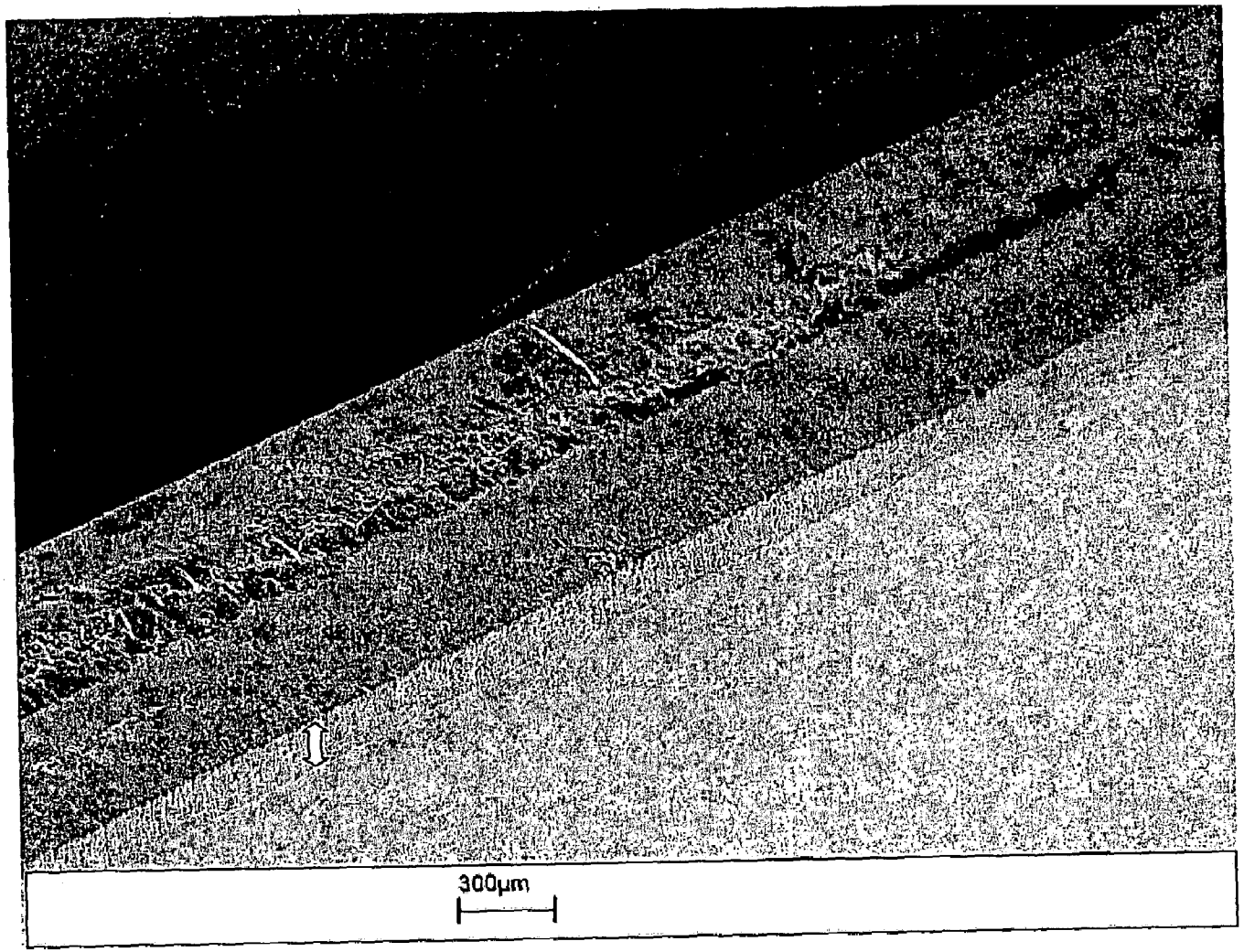

FIG. 10 represents a similar SEM view, but of the creping blade according to the present invention after a running time of 142 hours on this machine. The sliding wear path, indicated by the arrow in the figure, was found to have a width of 150 μm. This should be compared to the result evidenced by FIG. 9 for the state of the art blade for a similar running time on the same machine.

As a conclusion of this example, the resistance to chips on cast iron for a tissue grammage this low is greatly improved by the use of blades according to the invention. It should be pointed out that blade chips in connection with such very light tissue may be responsible for web breaks, and consequently loss in productivity.

In addition, the lower sliding wear path obtained for the inventive blade compared to the state of the art blades (150 μm compared to 550 μm) will ensure a more uniform scraping efficiency of the coating chemicals over time, and therefore also a more constant creping process.

Example 3

On yet another tissue machine, currently employing alumina-based ceramic tipped creping blades, a comparative trial was performed between state of the art blades and blades according to the present invention.

The running conditions for the creping process were the following:

paper web made from 100% virgin fibers;

soft toilet paper tissue type grammage of 21 g/m$^2$;

Yankee speed of 1100 m/min;

Yankee surface comprised of cast iron;

creping blade dimensions of 1.2×120×2790 mm (thickness×width×length);

blade bevel of 75 degrees (−15 degrees from square edge).

Figure 11:
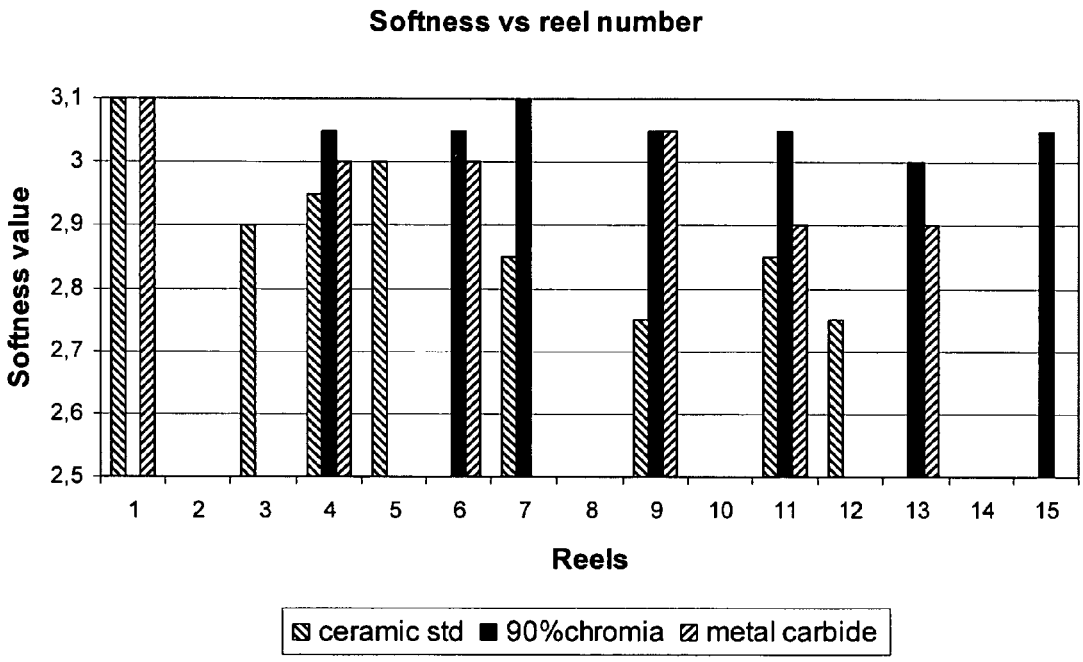
FIG. 11 is a graph representing softness obtained for three different types of blades and is referred to in Example 3 below.

State of the art ceramic tipped and metal carbide tipped blades were compared to a blade according to the present invention. The blade according to the invention had a 90% chromia—10% titania composition. In this case, the softness attributed value is an important criteria for this tissue mill. The three blade types were run for about 8 hours during 3 consecutive days of production of the same grade. The desired softness value is 3.0, with a minimum acceptable value of 2.6. FIG. 11 shows a graph representing the results obtained by the three types of blades.

Clearly, this trial shows that for high quality tissue grade, the state of the art ceramic blade is not able to reach the same results as the metal carbide blade, i.e. to keep the softness as constant and high as possible. The blade according to the invention, however, (in this case with a ceramic having 90% chromia and 10% titania) gives a softness comparable to that of the metal carbide tipped blade, but lacks the potential drawbacks with respect to friction compatibility.

Example 4

In the tissue machine of Example 2 above, tests were performed (under the same running conditions as outlined in Example 2 above) in order to inspect the wear pattern of the worn blades. A comparison was made between alumina-zirconia ceramic tipped blades of the prior art and chromia-titania ceramic tipped blades according to the present invention. Inspection of the worn blades was made by scanning electron microscopy (SEM).

Figure 12:
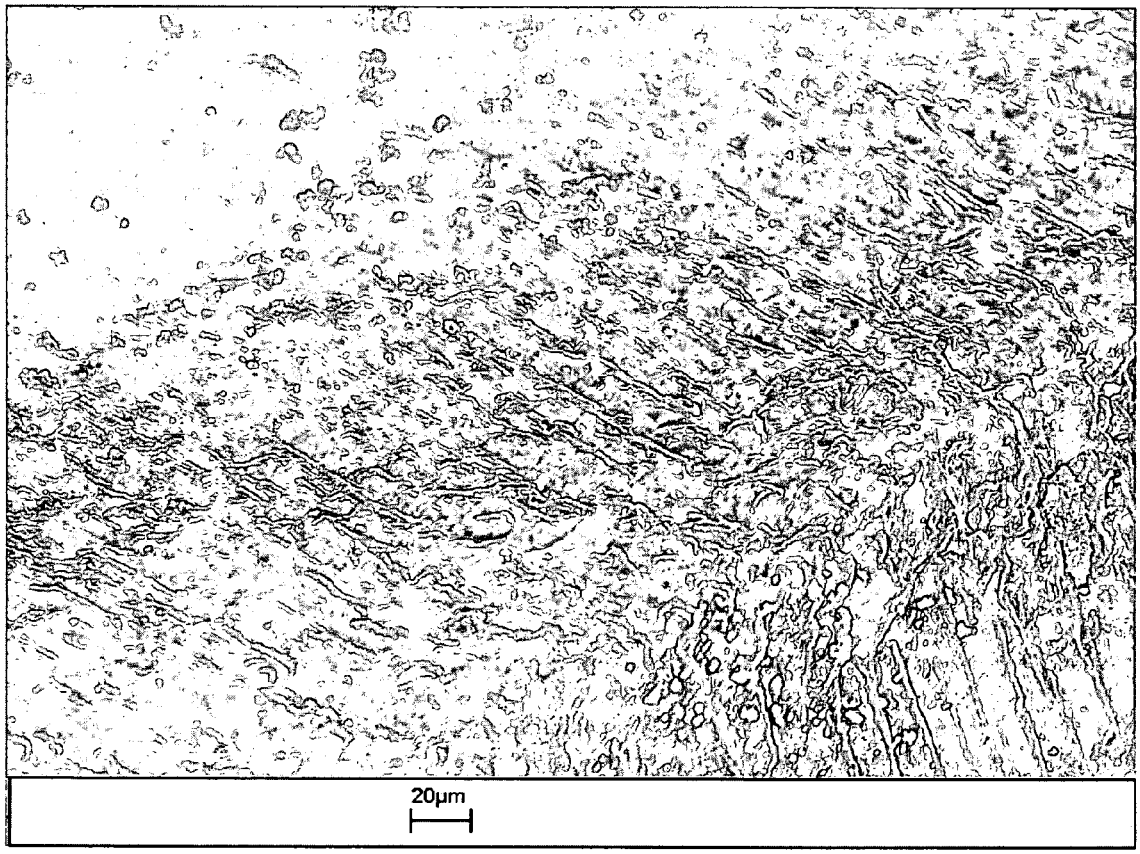
FIGS. 12 and 13 are SEM views showing wear patterns after two different running times for a prior art blade.

FIG. 12 shows a SEM view of the wear pattern created by running web on a state of the art alumina-zirconia ceramic tipped blade after a running time of 28 hrs.

Figure 13:
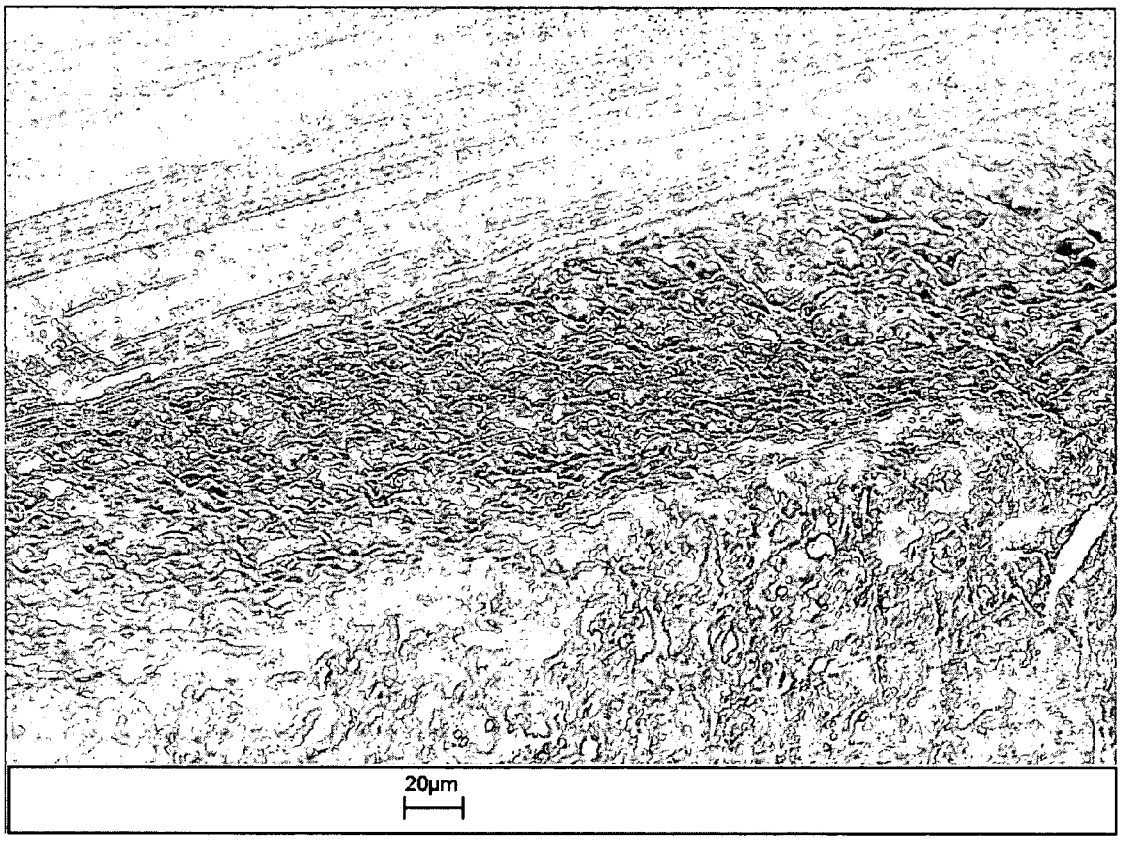

FIG. 13 shows a view similar to that shown in FIG. 12, but now after a running time of 131 hrs.

FIG. 14 shows again a view similar to FIGS. 12 and 13, but now for a blade according to the present invention. The blade shown in FIG. 14 has a ceramic coating of chromia with 15% by weight titania. The wear pattern shown in FIG. 14 was created after a running time of 116 hrs.

Figure 14:
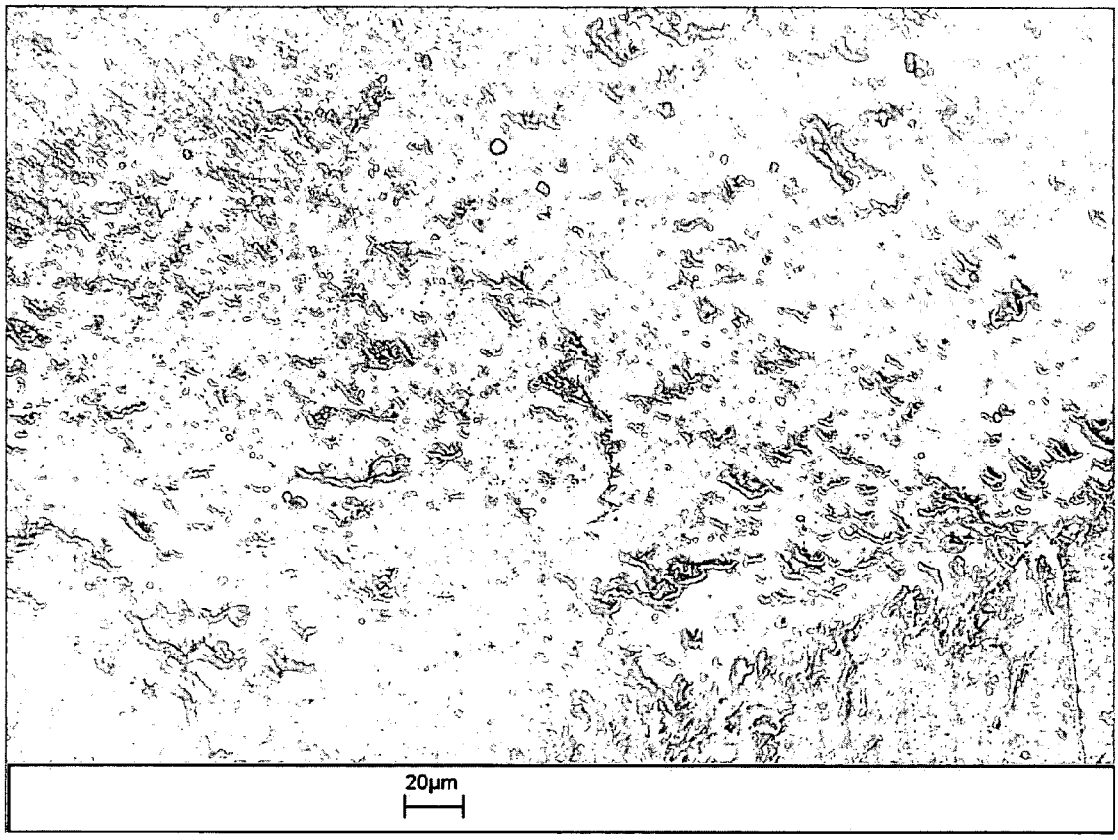
FIG. 14 is a SEM view showing the wear pattern for a creping blade according to the present invention.

FIGS. 12 to 14, which all have the same magnification, clearly show that the wear of a multiphase material such as alumina with 40% by weight zirconia leads to a quite rough wear pattern, while the use of a single phase material according to the invention (chromia with 15% by weight titania) gives a very smooth impact wear pattern on the blade. This difference in impact wear pattern can explain why the use of a ceramic tipped blade according to the present invention leads to a decrease in the frequency of web breaks compared to a prior art multiphase ceramic material.

CONCLUSION

A blade for creping has been described. The blade according to the invention has a ceramic top layer covering the working edge of the blade, as well as the surface upon which the web impacts during creping. The ceramic top layer is a ceramic composition having a content of chromia. Preferably, the ceramic composition of the top layer comprises chromia-titania, with a titania content of up to 25% by weight, and preferably between 10% and 15% titania.

The blade according to the present invention leads to lower sliding wear at the working edge of the blade, which in turn gives a more uniform scraping efficiency. Moreover, the ceramic top layer of the blade according to the present invention is comprised of a single phase composition, leading to a comparatively uniform impact wear at the areas where the web impacts the creping blade. This, in turn, has the advantage that the creping process is more constant over time and that the occurrence of web breaks is drastically reduced.

Although the present invention has been described by way of a number of detailed examples, it should be understood that the invention can be embodied in various other ways within the scope of the appended claims.

The invention claimed is:

1. A blade for creping a paper web from a surface, said blade comprising a steel substrate which is covered by a ceramic top layer that forms a working edge adapted for contact with said surface and a web impact area upon which the web impacts during creping, wherein the ceramic composition of said ceramic top layer comprises chromia-titania ($Cr_2O_3/TiO_2$) with a titania ($TiO_2$) content from 5% to 25% by weight.

2. A blade according to claim 1, wherein the ceramic top layer is a single phase ceramic material.

3. A blade according to claim 1, wherein the ceramic top layer has a titania content in the range from 5% to 15% by weight.

4. A blade according to claim 3, wherein the ceramic top layer has a titania content in the range from 10% to 15%.

5. A blade according to claim 1, wherein said top layer is a thermally sprayed ceramic layer.

6. A blade according to claim 1, wherein the thickness of the ceramic top layer at the edge section of the blade is in the range from 150 to 300 μm.

7. A blade according to claim 6, wherein the thickness of the ceramic top layer at the edge section of the blade is in the range from 200 to 300 μm.

8. A blade according to claim 1, further comprising a bond coat between the steel substrate and the ceramic top layer.

9. A blade according to claim 8, wherein said bond coat comprises Ni—Cr.

10. A blade according to claim 8, wherein said bond coat has a thickness between 10 and 50 μm.

11. A blade according to claim 1, wherein the steel substrate has a prebevel with an angle of up to 10 degrees, upon which the ceramic top layer is deposited.

12. A blade according to claim 11, wherein said prebevel has an angle of 4–8 degrees.

13. A blade according to claim 1, wherein the steel substrate has a thickness in the range from 0.635 to 1.250 mm.

14. A blade according to claim 1, wherein the steel substrate has a width in the range from 50 to 150 mm.

15. A blade according to claim 14, wherein the steel substrate has a width in the range from 75 to 120 mm.

* * * * *